US005426293A

United States Patent [19]

Miller et al.

[11] Patent Number: 5,426,293

[45] Date of Patent: Jun. 20, 1995

[54] SENSING EDGE HAVING A PHOTOELECTRIC SWITCH POSITIONED THEREIN

[75] Inventors: Bearge D. Miller, Concordville; Anatoly Galperin, Philadelphia, both of Pa.

[73] Assignee: Miller Edge, Concordville, Pa.

[21] Appl. No.: 56,000

[22] Filed: Apr. 29, 1993

[51] Int. Cl.[6] ..... E05F 15/20

[52] U.S. Cl. ..... 250/221; 250/222.1; 49/26

[58] Field of Search ..... 250/221, 222.1, 231.1; 49/26, 27, 28

[56] References Cited

U.S. PATENT DOCUMENTS

| | | | |
|---|---|---|---|
| Re. 34,665 | 7/1994 | Strand | 250/221 |
| 3,001,038 | 9/1961 | Gessell | 200/61.43 |
| 3,003,303 | 10/1961 | Wright | 57/78 |
| 3,462,885 | 8/1969 | Miller | 49/488 |
| 4,115,952 | 9/1978 | French | 49/26 |
| 4,301,621 | 11/1981 | Houweling | 49/27 |
| 4,452,009 | 6/1984 | Baumeler et al. | 49/25 |
| 4,773,183 | 9/1988 | Okushima et al. | 49/28 |
| 4,944,116 | 7/1990 | Mewald | 49/27 |
| 4,953,608 | 9/1990 | Larsson | 160/1 |
| 5,079,417 | 1/1992 | Strand | 250/221 |
| 5,259,143 | 11/1993 | Mitchell et al. | 49/27 |

FOREIGN PATENT DOCUMENTS

| | | |
|---|---|---|
| 382925 | 4/1987 | Austria . |
| 2658660 | 6/1978 | Germany . |
| 3107847 | 2/1982 | Germany . |

*Primary Examiner*—David C. Nelms
*Assistant Examiner*—John R. Lee
*Attorney, Agent, or Firm*—Panitch Schwarze Jacobs & Nadel

[57] ABSTRACT

A sensing edge for controlling movement of a door by actuation of a device upon an external force being applied to the sensing edge. The sensing edge includes an elongated, generally flexible tubular sheath which is secured to the door. The sheath includes an elongated, entirely hollow cavity with an optically reflective interior surface. A light transmitter is positioned proximate a first end of the sheath for transmitting a light beam toward a second end of the sheath. A light detector is positioned proximate the second end of the sheath for detecting the presence or absence of the light beam at the second sheath end. The light detector generates a signal for actuating the device upon detecting the absence of the light beam at the second end of the sheath.

7 Claims, 2 Drawing Sheets

FIG. 1
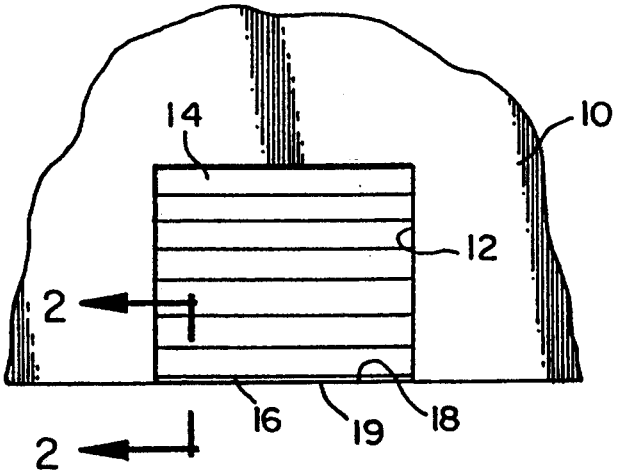
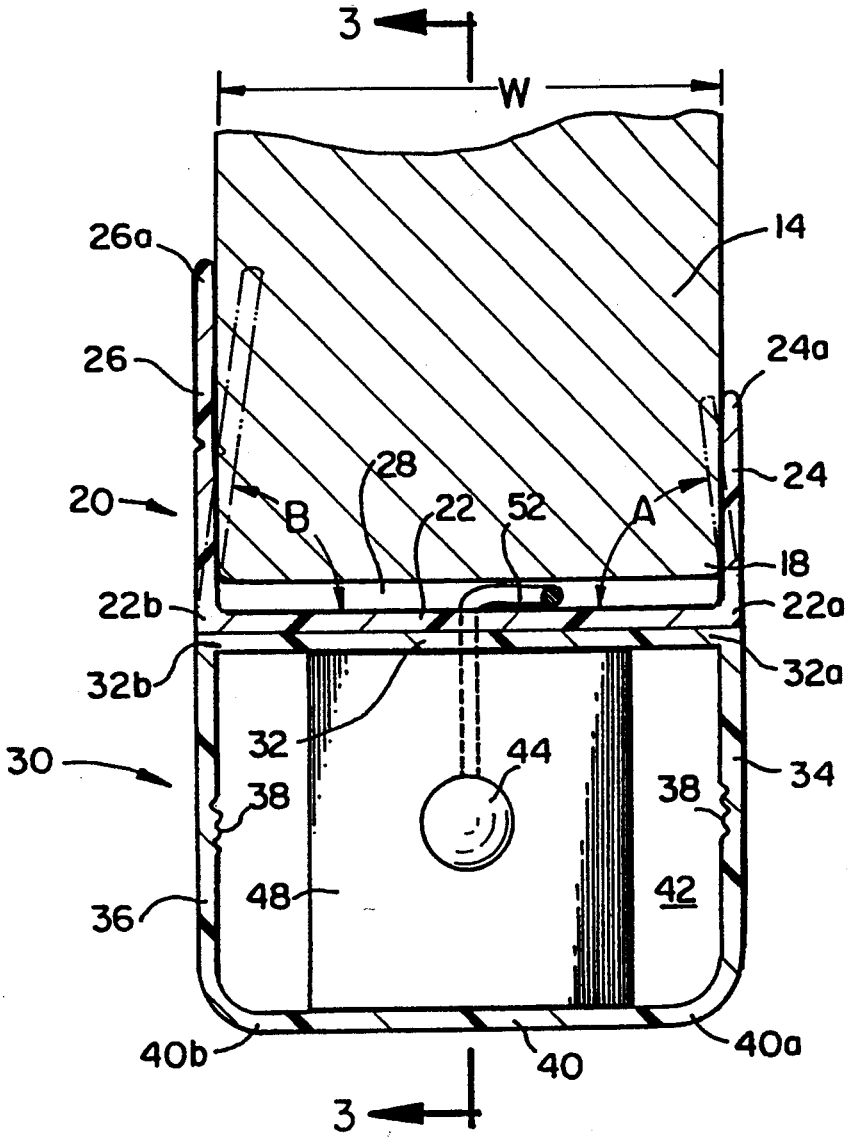
FIG. 2

SENSING EDGE HAVING A PHOTOELECTRIC SWITCH POSITIONED THEREIN

FIELD OF THE INVENTION

The present invention relates to a sensing edge for controlling movement of a door and, more particularly to a sensing edge having a photoelectric switch positioned therein.

BACKGROUND OF THE INVENTION

Conventional sensing edges generally include a sheath having a cavity formed along the length of the sheath wherein at least a portion of a switch is located. The sensing edge is attached to an edge of a door which may be moved in different directions. When external pressure is applied to the sheath of the sensing edge, the switch is activated. The activated switch actuates a door control device, which in turn causes the door to either stop moving or to open. For example, external pressure may be applied to the sheath when the sheath contacts an obstructing article such as a tool or a portion of the body of a person, located between the sensing edge and an opposed surface. By stopping or changing the direction of movement of the door, damage to the obstructing article may be prevented.

Many types of conventional sensing edges, which operate generally as described above, exist. For example, A first conventional sensing edge includes a photoelectric switch comprising a light transmitter and a light detector. The light transmitter and the light detector are positioned a predetermined distance below a leading edge of a door and at opposite ends of the leading edge such that the light transmitter transmits a light beam across the length of the door toward the light detector. The light beam is blocked from reaching the light detector when an article obstructs the downward movement of the door. When the light detector senses the absence of the light beam, the light detector sends a signal to a door control device, which in turn causes the door to either stop moving or to open.

The first conventional sensing edge is flawed because the light transmitter and the light detector are not contained within a protective covering, such as a sheath. Therefore, the light transmitter and the light detector are subject to damage from natural forces (such as rain, wind, snow, etc.) and artificial forces (such as misdirected balls, errant bicycles, maliciously thrown rocks, etc.).

A second conventional sensing edge includes a mounting member which is attached to the leading edge of a door. The mounting member includes a pair of downwardly extending arms which form a slot-like opening. Extended pockets are located on opposite sides of the arms for receiving the ends of an outer covering. A segment is associated with the outer covering and is located directly beneath and aligned with the slotted opening. A light transmitter and a light detector are located within the slotted opening at opposite ends of the slotted opening such that the light transmitter directs a beam of light across the width of the slotted opening towards the light detector. When external pressure is directly applied to the outer covering, at a precise angle relative to the segment and the slotted opening, the segment is caused to move into the slotted opening, thereby blocking the light beam from reaching the light detector. When the light detector detects the absence of light, the light detector sends a signal to a door control device, which in turn causes the door to either stop moving or to open.

The second conventional sensing edge is flawed because an obstacle is detected only if it causes external pressure to be applied to the outer covering at a precise angle relative to the segment and the slotted opening, such that the segment enters the slotted opening. Obstructions which apply external pressure at different angles relative to the segment and the slotted opening are not detected. Furthermore, the light source and the light detector must be precisely aligned in order to enable the light detector to detect the light beam transmitted by the light transmitter.

A third conventional sensing edge includes a deformable, partially hollow body which is attached to the leading edge of a door. A hollow profile which acts as a light guide is positioned within the partially hollow body, wherein the hollow profile has a slit formed therein. A light transmitter and a light detector are positioned within the hollow profile at opposite ends of the profile such that the light transmitter at one end of the profile transmits a light beam toward the light detector at the other end of the profile. When external pressure is applied to the sensing edge, the profile contained within the partially hollow body is deformed, thereby opening the slit formed in the profile. The opening of the slit allows light to escape (or dissipate) from the profile into the partially hollow body, thereby decreasing the amount of light within the profile and detected by the light detector. If the amount of light detected by the light detector is below a predetermined limit, the light detector sends a signal to a door control device which causes the door to stop moving or to open.

The third conventional sensing edge is flawed because precise alignment and adjustment of the light transmitter and the light detector are necessary due to potential deformations in the profile, particularly deformations in the profile proximate the slit. Such deformations would allow light to escape from the profile into the body, even when external pressure was not applied to the sensing edge. Therefore, the light transmitter and light detector in each sensing edge must be individually precisely aligned and carefully adjusted to compensate for any deformations in the profile proximate the slit. Such alignment and adjustment are necessary even when the interior surfaces of the profile are treated or otherwise coated to be light reflective, since such treatment or coating would not entirely compensate for deformations in the profile proximate the slit.

Therefore, what is required is a sensing edge having a photoelectric switch comprising a light transmitter and a light detector, wherein the light transmitter and light detector are protected from natural and artificial forces, and wherein the switch is activated upon external pressure being applied at any angle to the sensing edge, and wherein precise alignment and adjustment of the light transmitter and the light detector are not required.

SUMMARY OF THE INVENTION

Briefly stated, the present invention comprises a sensing edge for controlling movement of a door moving in a first direction by actuation of a device upon external force being applied to the sensing edge. The sensing edge includes an elongated base member for being secured to a leading edge of the door and an elongated, generally flexible tubular sheath secured to the base member and having a longitudinal axis. The sheath includes an elongated, entirely hollow cavity extending generally parallel to the longitudinal axis of the sheath. The sheath further includes a first open end, a second open end, and an optically reflective interior surface. A light transmitter is positioned in the cavity proximate the first end of the sheath for transmitting a light beam toward the second end of the sheath through the cavity and generally parallel to the longitudinal axis of the sheath. A light detector is positioned in the cavity proximate the second end of the sheath in alignment with the light transmitter. The light detector detects the presence or absence of the light beam at the second end of the sheath and generates a signal for actuating the device upon detecting the absence of the light beam at the second end. When external pressure is applied to the sheath, a portion of the sheath is compressed into the cavity, thereby blocking passage of the light beam through the cavity and causing the light detector to generate the signal and actuate the device.

BRIEF DESCRIPTION OF THE DRAWINGS

The foregoing summary, as well as the following detailed description, is better understood when read in conjunction with the appended drawings. For the purpose of illustrating the invention, an embodiment which is presently preferred is shown in the drawings. It is understood, however, that this invention is not limited to the precise arrangements and instrumentalities shown. In the drawings:

FIG. 1 is a front elevational view showing a door construction including a sensing edge in accordance with the present invention;

FIG. 2 is a greatly enlarged cross-sectional view of a portion of the door and the sensing edge of FIG. 1 taken along line 2—2 of FIG. 1.

DETAILED DESCRIPTION OF THE PREFERRED EMBODIMENTS

Figure 3:
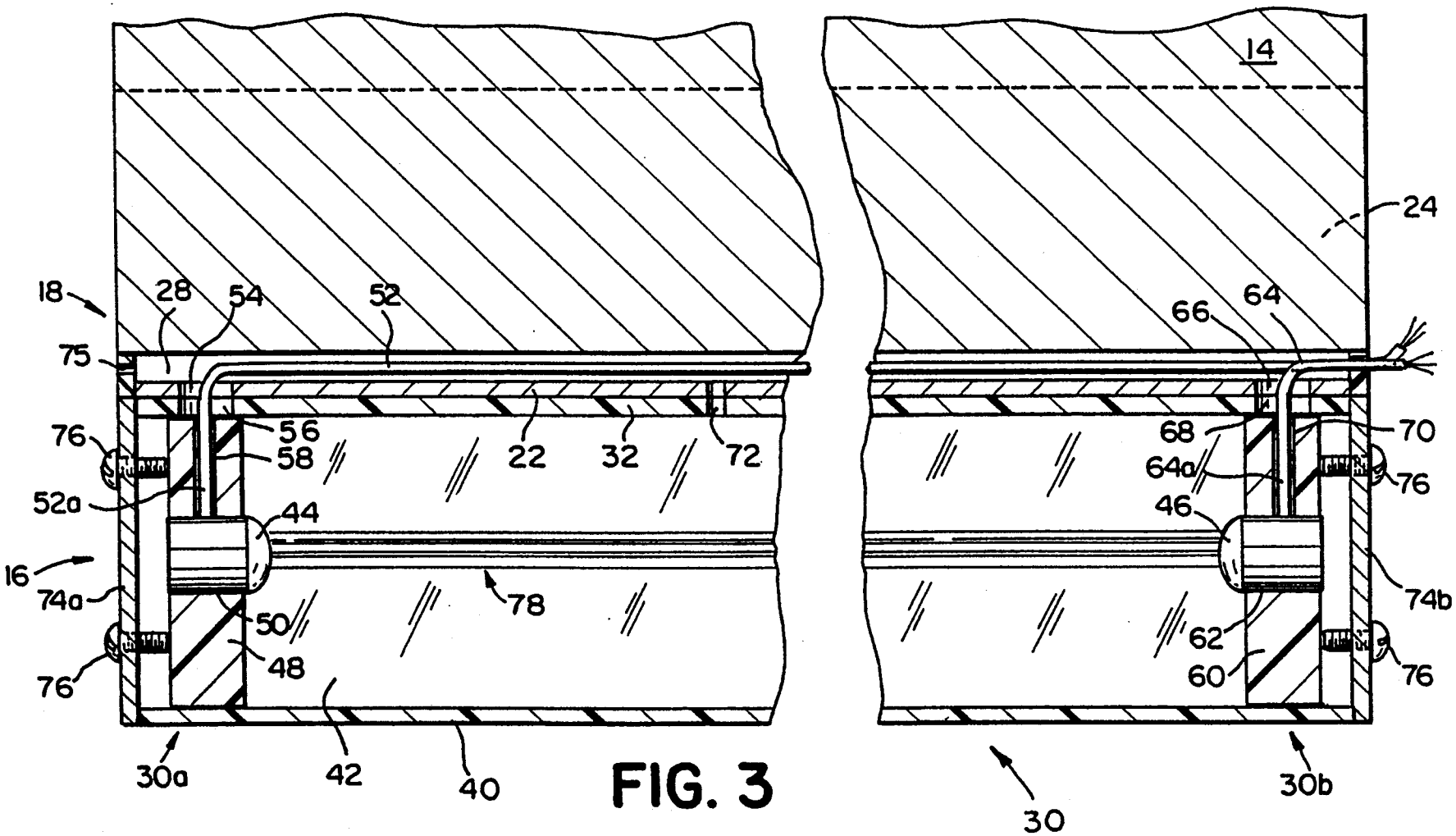
FIG. 3 is a cross-sectional view of a portion of the door and the sensing edge of FIG. 2 taken along line 3—3 of FIG. 2.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the sensing edge and designated parts thereof. The terminology includes the words above specifically mentioned, derivatives thereof and words of similar import.

Referring to the drawings in detail, wherein like reference numerals indicate like elements throughout, there is shown in FIG. 1 a wall 10 having a doorway opening 12 provided with a door 14. For purposes of illustration, the door 14 is shown as an overhead door having a sensing edge 16 in accordance with the present invention along its lower side or leading edge 18. When the door 14 is fully closed (as shown in FIG. 1), the leading edge 18 is adjacent to and contacts an opposed surface or floor 19. However, one of ordinary skill in the art would understand that the sensing edge 16 may be located along any edge of any door structure, such as vertically or horizontally movable doors (not shown), without departing from the spirit and scope of the present invention.

As shown in FIG. 3, the sensing edge 16 extends substantially along the entire length of the leading edge 18 of the door 14. The sensing edge 16 controls movement of the door 14 by actuating a door control device (not shown) upon external force being applied to the sensing edge 16. As shown in FIG. 1, the door 14 is capable of movement in a generally vertical direction in a plane generally parallel to that of the wall 10. For example, when the door 14 and sensing edge 16 are moving in a generally downward direction, if the sensing edge 16 encounters an obstructing article (not shown) at the leading edge 18, the sensing edge 16 senses the obstructing article and actuates the door control device to inhibit or change the direction of movement of the door 14, i.e., to a generally upward direction.

Referring now to FIG. 2, the sensing edge 16 comprises a generally rigid elongated base member 20. The base member 20 is designed to clamp onto the leading edge 18 of the door 14, preferably without the need for adhesive or any other type of fasteners, such as screws. The base member 20 includes a mounting plate 22 having a first end **22*a*, a second end 22*b*, a first or upper surface facing the leading edge 18 of the door 14**, and a second or lower surface opposite to the first surface. The upper and lower surfaces are generally planar and preferably extend generally parallel with respect to each other.

A first elongated clamping member 24 extends from the first end **22*a* of the mounting plate 22 to form an angle A between the first elongated clamping member 24 and the mounting plate 22. The angle A is preferably less than 90°, and more preferably is about 80° prior to clamping the base member 20 onto the leading edge 18 of the door 14, as shown in phantom in FIG. 2**.

A second elongated clamping member 26 extends outwardly from the second end **22*b* of the mounting plate 22 generally toward the first clamping member 24 to form an angle B with the mounting plate 22. Angle B is preferably less than 90°, and more preferably is about 80° prior to clamping the base member 20 onto the leading edge 18 of the door 14, as shown in phantom in FIG. 2. After the base member 20 is clamped onto the leading edge 18, the angles A and B are preferably each about 90°, although one of ordinary skill in the art would understand that the angles A and B may be varied, as desired, and are dictated by the external configuration of the leading edge 18 of the door 14**.

The first and second clamping members 24, 26 and the mounting plate 22 form a generally trihedrally shaped base member 20 wherein the distance between distal ends **24*a*, 26*a* of the first and second clamping members 24, 26, respectively, is less than a width W of the leading edge 18 of the door 14. As shown in FIG. 2, the base member 20 forms a slot for receiving the leading edge 18 of the door 14 and for attaching the mounting plate 22 proximate the leading edge 18 such that the mounting plate 22 is positioned generally parallel to and spaced from the leading edge 18 to define a chamber 28 therebetween which extends along the leading edge 18 of the door 14. The chamber 28 includes an axis extending along and being substantially parallel to a longitudinal axis of a sheath 30** (described below).

It is preferred that the base member 20 be constructed of a polymeric material having sufficient flexibility such that the first and second clamping members 24, 26 can be forced slightly outwardly to receive the leading edge 18 of the door 14. In other words, the first and second clamping members 24, 26 are biased inwardly such that once the leading edge 18 of the door 14 is positioned therebetween, the first and second clamping members 24, 26 exert an inwardly directed force on opposite sides of the door 14 to firmly grip and thereby secure the base member 20 to the door 14, as illustrated in FIG. 2.

One of ordinary skill in the art will understand, however, that the base member 20 may alternatively or additionally be attached to the leading edge 18 of the door 14 by standard fasteners, such as nails, bolts, screws, tacks, or an adhesive or other fastener means without departing from the spirit and scope of the present invention.

Preferably, the base member 20 is constructed of a generally rigid material, such as Santoprene TM 103-50, which is commercially available from Monsanto Co. of St. Louis, Mo. However, it will be understood by those skilled in the art that the base member 20 could be constructed of other materials which are sufficiently rigid to ensure the structural integrity of the sensing edge 16, such as polyvinyl chloride, neoprene, or other polymeric materials, and such as aluminum, steel, or other metals. The base member 20 may be formed by extrusion molding, die molding, or milling.

As best shown in FIG. 2, the sensing edge 16 further includes an elongated generally flexible tubular sheath 30, preferably having a generally constant cross-sectional outline configuration. As presently preferred, the sheath 30 has a generally rectangular cross-section with rounded exterior corners, but one of ordinary skill would understand that any other suitable cross-sectional shape, such as oval, circular, semicircular, elliptical or square (not shown) may be used in accordance with the present invention.

As best shown in FIG. 3, the sheath 30 includes a first end 30*a* and a second end 30*b*. The sheath 30 also includes a longitudinal axis which generally extends generally parallel to the leading edge 18 of the door 14.

Referring again to FIG. 2, in the present embodiment, the sheath 30 includes a generally elongated first wall 32 having a first end 32*a*, a second 32*b*, a first or upper surface, and a second or lower surface. The upper surface of the first wall 32 is secured to the second surface of the mounting plate 22 of the base member 20 by using standard fasteners, such as nails, bolts, screws, tacks, or an adhesive or other fastener means.

A first leg 34 and a second leg 36 extend outwardly or downwardly from the lower surface of the first wall 32. The first leg 34 is generally parallel to and spaced apart from the second leg 36 to define an elongated, entirely hollow cavity 42 formed within the sheath 30 along the longitudinal axis of the sheath 30. A plurality of grooves 38 are preferably positioned on an inner surface of the first leg 34 and on an inner surface of the second leg 36 for increasing the flexibility of the first leg 34 and the second leg 36. One of ordinary skill in the art would understand, however, that the grooves 38 may be omitted or positioned on the outer surfaces of the first leg 34 and the second leg 36. Moreover, the present invention is not limited to any particular number of grooves 38 on the first and second legs 34, 36. The grooves 38 are preferably U-shaped in cross section, but may be formed in any shape, such as semicircular, V-shaped, or any other suitable shape as desired.

The sheath 30 also includes a second wall 40 having a first or upper surface and a second or lower surface. The second wall 40 is located generally parallel to and spaced apart from the first wall 32 to further define the cavity 42 therebetween. The second wall 40 includes a first end 40*a* connected to the first leg 34 and a second end 40*b* connected to the second leg 36. It is preferred that the first and second walls 32, 40 be generally planar, although either or both of the first and second walls 32, 40 may be generally arcuate or include corrugations, for example.

It should be understood that the first leg 34, second wall 40, and second leg 36 may be implemented as a single, generally continuous wall preferably having a generally U-shaped cross-section (the wall can have other cross-sectional shapes, such as semi-oval, semicircular, V, square, etc.). Alternatively, the first wall 32, first leg 34, second wall 40, and second leg 36 can be implemented as a single, generally continuous wall preferably having a generally square-shaped cross-section (the wall can have other cross-sectional shapes, such as oval, circular, etc.).

As best shown in FIG. 3, the inner surfaces of the sheath 30-are preferably optically reflective. Such optical reflectiveness can be achieved by coating and/or otherwise treating the inner surfaces of the sheath 30 with an optically reflective material.

The sheath 30 may be formed by extrusion molding, dye molding, milling, or any other well-known method. It is preferred that the sheath 30 be formed from elastomeric materials, and more preferably from Santoprene TM 101-55, which is commercially available from Monsanto Co., although those skilled in the art will appreciate that the sheath 30 can be formed from other elastomers such as PVC, neoprene, etc.

The sensing edge 16 also includes a generally rigid first block 48 secured within the cavity 42 between the first and second walls 32, 40 proximate the first end 30*a* of the sheath 30. Preferably, the first block 48 is secured within the cavity 42 by frictional engagement with the lower surface of the first wall 32 and with the upper surface of the second wall 40, although those skilled in the art will appreciate that the first block 48 can be secured within the cavity 42 using other well-known methods. An opening 50 is formed in the first block 48.

The first block 48 is formed from a generally rigid material such as steel, aluminum, copper, Santoprene TM 103-50, neoprene, polyvinyl chloride, etc. The first block 48 holds a transmitter means, such as a light transmitter 44, in the opening 50 (the light transmitter 44 is further described below). Because the first block 48 is made from a generally rigid material, the first block 48 is itself generally rigid and, therefore, the first block 48 does not collapse when the sheath 30 contacts the floor 19 or an obstructing object. Therefore, the first block 48 prevents damage to the light transmitter 44 when the sheath 30 contacts the floor 19 or an obstructing object.

As indicated above, the sensing edge 16 further includes a transmitter means, such as a light transmitter 44, which is positioned proximate the first end 30*a* of the sheath 30. Specifically, the light transmitter 44 is secured within the opening 50 formed in the first block 48. The light transmitter 44 transmits a light beam 78 within the cavity 42 from the first end 30*a* of the sheath 30 toward the second end 30*b* of the sheath 30 along a path which is concentric with or generally parallel to the longitudinal axis of the sheath 30.

The sensing edge 16 further includes first conducting means such as first electrical conductor 52 having a first end 52*a* and a second end (not shown). The first conductor 52 electrically connects the light transmitter 44 to a power supply (not shown) to supply power to the light transmitter 44. The first electrical conductor 52 includes one or more electrical wires depending on the electrical structure of the light transmitter 44. For example, the first electrical conductor 52 may include a power wire and a ground wire if such connections are required by the light transmitter 44.

As best shown in FIG. 3, a portion of the first conductor 52 is positioned within the chamber 28. In particular, the portion of the first conductor 52 is positioned within and extends generally parallel to substantially the entire longitudinal axis of the chamber 28. Preferably, the first end 52*a* of the first conductor 52 extends through an aperture 54 in the mounting plate 22, an aperture 56 in the first wall 32, and an aperture 58 in the first block 48. The first end 52*a* of the first conductor 52 is electrically connected to the light transmitter 44. The second end of the first conductor 52 extends through an aperture (not shown) in a second end panel 74*b* (described below), such that the second end of the first conductor 52 is electrically connectable to a power supply (not shown) located external to the sensing edge 16.

The sensing edge 16 further includes a second block 60 secured within the cavity 42 between the first and second walls 32, 40 proximate the second end 30*b* of the sheath 30. Preferably, the second block 60 is secured within the cavity 42 by frictional engagement with the lower surface of the first wall 32 and with the upper surface of the second wall 40, although those skilled in the art will appreciate that the second block 60 can be secured within the cavity 42 using other well-known methods. An opening 62 is formed in the second block 60. The structure and function of the second block 60 is the same as the first block 48, except that the second block 60 holds and protects from damage a detector means such as a light detector 46 (described below).

As indicated above, the sensing edge 16 further includes a detector means, such as a light detector 46, positioned proximate the second end 30*b* of the sheath 30. Specifically, the light detector 46 is secured within the opening 62 formed in the second block 60. Preferably, the light detector 46 is positioned in alignment with the light transmitter 44. The light detector 46 detects the presence or absence of the light beam 78 at the second end 30*b* of the sheath 30. When the light detector 46 detects the absence of the light beam 78 at the second end 30*b* of the sheath 30, the light detector 46 signals, in some manner, a door control device (not shown), thereby activating the door control device such that the door control device stops movement of the door 14 or opens the door 14. The manner in which the light detector 46 signals the door control device depends on the type of light detector that is used. Generally, there are two types of light detectors: normally-open and normally-closed. If the light detector 46 is of the normally-open type, then upon detecting the absence of the light beam 78, the light detector 46 closes a normally-open switch located inside the light detector 46. If the light detector 46 is of the normally-closed type, then upon detecting the absence of the light beam 78, the light detector 46 opens a normally-closed switch located inside the light detector 46. The door control device monitors the light detector 46 in a well known manner to detect either the closing of the normally-open switch or the opening of the normally-closed switch. Upon detecting such closing or opening, the door control device is actuated and acts accordingly. It should be noted that the light detector 46 can signal the door control device in other ways, such as actively generating and transmitting a signal to the door control device either directly or through an immediary device such as a relay (not shown).

In practice, the light detector 46 detects the absence of the light beam 78 by determining when the amplitude of the light beam 78 falls below a predetermined light amplitude level (as detected by the light detector 46 at the second end 30*b* of the sheath 30). The light detector 46 can be adjusted (for example, during manufacture, assembly, or installation) to set the value of the predetermined light amplitude level in order to adjust the sensitivity of the sensing edge 16. The sensitivity of the light detector 46 may also be adjusted during installation of the sensing edge to compensate for differences in the length of the door to which the sensing edge is attached.

The sensing edge 16 further includes a second conducting means, such as second electrical conductor 64, having a first end 64*a* and a second end (not shown). The second conductor 64 may include one or more electrical wires depending on the electrical structure of the light detector 46. For example, the second conductor 64 may include three wires, two power wires and one signal wire. A portion of the second conductor 64 extends through a portion of the chamber 28. Preferably, the first end 64*a* of the second conductor 64 extends through an aperture 66 in the mounting plate 22, an aperture 68 in the first wall 32 and an aperture 70 in the second block 60. The first end 64*a* is electrically connected to the light detector 46. The second end of the second conductor 64 extends through an aperture (not shown) in the second end panel 74*b* such that the second end of the second conductor 64 is electrically connectable to the door control device (not shown) located external to the sensing edge 16. The second conductor 64 electrically connects the light detector 46 to the door control device (not shown), such that the signal generated by the light detector 46 upon detecting the absence of the light beam 78 at the second end 30*b* of the sheath 30 can be electrically transferred to the door control device via the second conductor 64 in order to activate the door control device.

Preferably, the light transmitter 44 and the light detector 46 are Series S18 opposed mode photoelectric sensor pairs which are commercially available from Banner Engineering Corp. of Minneapolis, Minn. However, those skilled in the art will appreciate that other types of commercially available light transmitters and detectors could be used without departing from the spirit of the present invention. Preferably, the light transmitter 44 and the light detector 46 operate in the visible light range, although those skilled in the art will appreciate that the light transmitter 44 and the light detector 46 could alternatively operate in the infrared, ultraviolet, invisible, etc., areas of the light spectrum without departing from the spirit of the present invention.

As shown in FIG. 3, it is preferred that a first end panel 74*a* and a second end panel 74*b* close and seal the open ends 30*a* and 30*b*, respectively, of the sheath 30 (note that the first and second end panels 74*a* and 74*b* preferably seal both the chamber 28 and cavity 42). The first end panel 74*a* and the second end panel 74*b* are attached to the open ends 30*a* and 30*b*, respectively, of the sheath 30 using standard fasteners such as nails, bolts, screws, tacks, or an adhesive, etc. Because they are enclosed within the sealed sheath 30, the light transmitter 44 and the light detector 46 are protected from natural forces and artificial forces. One or more small holes 75 are formed in the first and second end panels 74*a* and 74*b* proximate the chamber 28. As described further below, the holes 75 allow air to escape from the cavity 42 and the chamber 28. Alternatively, the first and second end panels 74*a* and 74*b* do not have holes 75 but are instead constructed so that they seal the cavity 42 and only part of the chamber 28, such that air is allowed to escape from the chamber 28 through that portion of the open ends 30*a* and 30*b* proximate the chamber 28 which are not sealed by the first and second end panels 74*a* and 74*b*.

The sensing edge 16 further includes adjusting screws 76 mounted through apertures (not shown) in the first and second end panels 74*a*, 74*b*. As shown in FIG. 3, the adjusting screws 76 contact the first and second blocks 48, 60 and therefore the alignment of the light transmitter 44 and the light detector 46 secured in the first and second blocks 48, 60, respectively, can be adjusted by adjusting the adjusting screws 76. Those skilled in the art will appreciate that only minor alignment adjustments to the light transmitter 44 and light detector 46 are necessary since the interior surfaces of the sheath 30 are optically reflective, and therefore the light beam 78 transmitted by the light transmitter 44 will be detected by the light detector 46 at the second end 30*b* of the sheath 30 even if the light transmitter 44 and the light detector 46 are not in precise alignment. It should be noted that alignment adjustments to the light transmitter 44 and the light detector 46 are not generally required even when deformations exist in the sheath 30. This is true because such deformations do not allow the light beam 78 to escape, or dissipate, from the cavity 42, but at most partially block the direct path of a small portion of the light beam 78 from the first end 30A of the sheath 30 to the second end 30B. Such partial blockage is compensated for by the optical reflective nature of the interior surfaces of the sheath 30 and by adjustments to the sensitivity of the light detector 46 as described above.

The sheath 30 also includes an air passageway 72 comprising a first hole formed in the mounting plate 22 and a second hole formed in the first wall 32, wherein the second hole in the first wall 32 is positioned in direct alignment with the first hole in the mounting plate 22. The air passageway 72 allows air to pass between the cavity 42 and the chamber 28. More particularly, the air passageway 72 allows air to freely escape from the cavity 42 to the chamber 28 when the sheath 30 compresses due to external pressure being applied to the sheath 30. As noted above, the holes 75 in the first and second end panels 74*a*, 74*b* allow air to escape from the chamber 28 to the outside. Thus, compressibility of the sheath 30 is enhanced due to the operation of the air passageway 72 and the holes 75 and, consequently, the sensitivity of the sensing edge 16 to detect obstacles which come into contact with the sheath 30 is increased.

The operation of the sensing edge 16 shall now be described. When no external pressure is applied to the sheath, the entirely hollow chamber 42 formed by the sheath 30 is unobstructed. Therefore, the light beam 78 transmitted by the light transmitter 44 from the first end 30*a* of the sheath freely passes toward the second end 30*b* of the sheath 30. Therefore, the light detector 46 detects the presence of the light beam 78 at the second end 30*b* of the sheath 30 and consequently, does not interfere with the normal movement of the door 14. More particularly, the light detector 46 does not signal the door control device (not shown) on the second conductor 64 to cause the door control device to stop the downward movement of the door 14.

External pressure is applied to the sheath 30 when an article obstructs the downward movement of the door 14 and thereby comes in contact with the sheath 30. When external pressure is applied to the sheath 30, a portion of the sheath is compressed into the cavity 42. Such compression of the sheath 30 is aided by the flexible nature of the first and second legs 34, 36 as enhanced by the grooves 38 formed in the first and second legs 34, 36, and the air passageway 72 and holes 75 which allow air to escape from the cavity 42 to the outside (via the chamber 28) as the sheath 30 is compressed. Note that the air passageway 72, while facilitating such compression of the sheath 30, is sealed within the chamber 28 by the first and second end panels 74*a*, 74*b*. Additionally, the holes 75 are small and, therefore, water and other potential damage causing elements cannot enter the chamber 28 via the holes 75 (also, the holes 75 may be covered by an air permeable material which would allow air to pass therethrough, but would prevent the passing of water and other elements). Therefore, such potential damage causing elements cannot enter the cavity 42 from the chamber 28 via the air passageway 72 and holes 75.

As the portion of the sheath 30 is compressed into the cavity 42, the cavity 42 becomes blocked. Consequently, the light beam 78 transmitted by the light transmitter 44 towards the light detector 46 is blocked (partially or fully) from reaching the light detector 46. Therefore, the light detector 46 detects the absence of some or all of the light beam 78 at the second end 30*b* of the sheath 30 and signals the door control device on the second conductor 64 (as described above), which in turn causes the door 14 to stop its downward movement. It should be understood that compression of the sheath 30 such that the cavity 42 becomes blocked is caused by external pressure being applied at any angle and to any portion along the length of the sheath 30.

The present invention may be embodied in other specific forms without departing from the spirit or essential attributes thereof and, accordingly, reference should be made to the appended claims, rather than to the foregoing specification, as indicating the scope of the invention.

We claim:

1. A sensing edge for controlling movement of a door moving in a first direction by actuation of a device upon force being applied to the sensing edge, the sensing edge comprising:

an elongated base member for being secured to the door;

an elongated generally flexible tubular sheath secured to the base member and having a longitudinal axis, the sheath including an elongated entirely hollow cavity extending generally parallel to the longitudinal axis, the sheath comprising a first open end, a second open end and an optically reflective interior surface;

a transmitter means positioned proximate the first end of the sheath for transmitting a light beam toward the second end of the sheath through the cavity and generally parallel to the longitudinal axis, the passage of the light beam through the cavity being blocked when external pressure is applied to a portion of the sheath to compress the sheath into the cavity; and a detector means positioned proximate the second end of the sheath in alignment with the transmitter means for detecting the light beam at the second end, and for generating a signal for actuating the device upon detecting an absence of the light beam when the passage of the light beam through the cavity is blocked;

the base member comprising:

a mounting plate having a first end, a second end, a first surface and a second surface;

a first elongated clamping member extending from the first end of the mounting plate;

a second elongated clamping member extending from the second end of the mounting plate, the first and the second clamping members forming a slot for receiving the door edge and for attaching the mounting plate proximate the door edge such that the mounting plate is positioned generally parallel to and spaced from the door edge to define a chamber therebetween, the chamber having an axis extending along and being substantially parallel to the longitudinal axis of the sheath;

the sheath comprising a first wall having a first surface and a second surface, the first surface of the first wall being secured to the second surface of the mounting plate, a first leg and second leg extending from the second surface of the first wall and being spaced apart to define the cavity therebetween, a second wall having a first surface and a second surface, the second wall being located generally parallel to and spaced from the first wall to further define the cavity therebetween, the second wall having a first end connected to the first leg and a second end connected to the second leg;

the sensing edge further comprising a block secured within the cavity between the first and second walls proximate the first end of the sheath, the transmitter means being supported by the block, whereby the block prevents damage to the transmitter means when the sheath is compressed due to external pressure being applied to the sheath;

the sensing edge further comprising adjusting means for adjusting the transmitter means relative to the detector means by adjusting the block in the cavity.

2. A sensing edge according to claim 1, further comprising an air passageway formed in the mounting plate and the first wall for allowing air to pass between the cavity and the chamber and for allowing air to escape from the cavity to the chamber when a portion of the sheath is compressed due to external pressure being applied to the sheath.

3. A sensing edge according to claim 1, further comprising a conductor means electrically connecting the transmitter means to a power supply for supplying power to the transmitter means, the conductor means comprising first and second ends, the conductor means including a portion positioned within the chamber, the first end of the conductor means extending through an aperture in the mounting plate, an aperture in the first wall and an aperture in the block, the first end of the conductor means being electrically connected to the transmitter means and the second end of the conductor means being electrically connectable to the power supply.

4. A sensing edge according to claim 3, wherein the portion of the conductor means extends along substantially the entire axis of the chamber.

5. A sensing edge for controlling movement of a door moving in a first direction by actuation of a device upon force being applied to the sensing edge, the sensing edge comprising:

an elongated base member for being secured to the door;

an elongated generally flexible tubular sheath secured to the base member and having a longitudinal axis, the sheath including an elongated entirely hollow cavity extending generally parallel to the longitudinal axis, the sheath comprising a first open end, a second open end and an optically reflective interior surface;

a transmitter means positioned proximate the first end of the sheath for transmitting alight beam toward the second end of the sheath through the cavity and generally parallel to the longitudinal axis, the passage of the light beam through the cavity being blocked when external pressure is applied to a portion of the sheath to compress the sheath into the cavity; and a detector means positioned proximate the second end of the sheath in alignment with the transmitter means for detecting the light beam at the second end, and for generating a signal for actuating the device upon detecting an absence of the light beam when the passage of the light beam through the cavity is blocked;

the base member comprising:

a mounting plate having a first end, a second end, a first surface and a second surface;

a first elongated clamping member extending from the first end of the mounting plate;

a second elongated clamping member extending from the second end of the mounting plate, the first and the second clamping members forming a slot for receiving the door edge and for attaching the mounting plate proximate the door edge such that the mounting plate is positioned generally parallel to and spaced from the door edge to define a chamber therebetween, the chamber having an axis extending along and being substantially parallel to the longitudinal axis of the sheath;

the sheath comprising a first wall having a first surface and a second surface, the first surface of the first wall being secured to the second surface of the mounting plate, a first leg and second leg extending from the second surface of the first wall and being spaced apart to define the cavity therebetween, a second wall having a first surface and a second surface, the second wall being located generally parallel to and spaced from the first wall to further define the cavity therebetween, the second wall having a first end connected to the first leg and a second end connected to the second leg;

the sensing edge further comprising a block secured within the cavity between the first and second walls proximate the second end of the sheath, the detector means being supported by the block, whereby the block prevents damage to the detector means when the sheath is compressed due to external pressure being applied to the sheath;

the sensing edge further comprising adjusting means for adjusting the detector means relative to the transmitter means by adjusting the block in the cavity.

6. A sensing edge according to claim 5, further comprising a conductor means electrically connecting the detector means to the device for electrically transferring the signal generated by the detector means upon detecting the absence of the light beam at the second end of the cavity to the device, the conductor means comprising first and second ends, the conductor means having a portion positioned within a portion of the chamber, the first end of the conductor means extending through an aperture in the mounting plate, an aperture in the first wall and an aperture in the block, the first end of the conductor means being electrically connected to the detector means and the second end of the conductor means being electrically connectable to the device.

7. A sensing edge according to claim 5, further comprising an air passageway formed in the mounting plate and the first wall for allowing air to pass between the cavity and the chamber and for allowing air to escape from the cavity to the chamber when a portion of the sheath is compressed due to external pressure being applied to the sheath.

* * * * *